US005882447A

United States Patent [19]

Kimura et al.

[11] Patent Number: 5,882,447

[45] Date of Patent: Mar. 16, 1999

[54] HEAVY-WALL STRUCTURAL STEEL AND METHOD

[75] Inventors: Tatsumi Kimura; Kiyoshi Uchida; Fumimaru Kawabata; Keniti Amano; Takanori Okui, all of Okayama, Japan

[73] Assignee: Kawasaki Steel Corporation, Japan

[21] Appl. No.: 562

[22] Filed: Dec. 30, 1997

Related U.S. Application Data

[62] Division of Ser. No. 697,645, Aug. 22, 1996, Pat. No. 5,743,972.

[30] Foreign Application Priority Data

Aug. 29, 1995 [JP] Japan ..... 7-220063

[51] Int. Cl.[6] ..... C21D 7/13

[52] U.S. Cl. ..... 148/654

[58] Field of Search ..... 148/654, 320, 148/330, 331, 333, 337

[56] References Cited

U.S. PATENT DOCUMENTS

| | | | |
|---|---|---|---|
| 4,025,368 | 5/1977 | Sanbonji et al. | 420/83 |
| 5,622,572 | 4/1997 | Wells et al. | 148/320 |

*Primary Examiner*—Deborah Yee
*Attorney, Agent, or Firm*—Austin R. Miller

[57] ABSTRACT

A heavy-wall steel having a flange thickness of about 40 mm or more and possessing excellent strength, toughness, weldability, and seismic resistance capable of being used for structure members such as columns and beams of high-rise buildings. The heavy-wall steel has a tensile strength of about 490–690 MPa, a yield ratio of about 80% or less, and Charpy absorbed energy at 0° C. of about 27 J or more at the center in terms of thickness of the flange portion in each of the rolling direction, the direction perpendicular to the rolling direction, and the plate-thickness direction.

8 Claims, No Drawings

HEAVY-WALL STRUCTURAL STEEL AND METHOD

This application is a divisional of application Ser. No. 08/697,645, filed Aug. 27, 1996, now U.S. Pat. No. 5,743, 972.

BACKGROUND OF THE INVENTION

1. Field of the Invention

The present invention relates to a heavy-wall steel having a flange thickness of about 40 mm or more. The invention can be used as a structural member, such as a column or a beam in a high-rise building, and can have an H-shape. This invention more specifically relates to the heavy-wall steel having excellent strength, toughness, weldability and seismic resistance.

2. Description of the Related Art

Hot-rolled gauge H steels are widely used as column members and beam members of buildings. Particularly, SM490, SM520, and SM590 gauge H steels that are standardized as rolled steels for welded structures by JIS G 3106 are frequently used. New buildings are continually being built to a larger scale, and in response, the gauge H steels being used are increasingly thicker and stronger. Presently, there is a demand for gauge H steels having a yield point or yield strength (YS) of 325 MPa or more, or of 355 MPa or more, a yield ratio of 80% or less, and excellent toughness.

However, the strength of ordinary steel is prone to decrease as thickness increases. In fact, it is difficult to provide high YS of 325 MPa or more, or 355 MPa or more, for a heavy-wall H-shaped steel having a flange thickness of 40 mm or more.

Further, producing high strength steels through ordinary production procedures utilizing hot-rolling requires increasing the Ceq value of the steel. Increasing the Ceq value causes problems such as increased weld cracking and reduced toughness in the heat affected zone (hereinafter referred to as HAZ).

Moreover, gauge H steels require a rolling process wherein the rolling force of the mill per unit cross-sectional area of the rolled material is small. Therefore, rolling methods used for gauge H steels employ a low rolling reduction (rolling reduction/pass=1–10%) performed at a high temperature (950° C. or more), which limits deformation resistance. However, satisfactory fine crystal grains cannot be obtained through this rolling method, and thus, satisfactory toughness cannot be achieved.

Some methods to which TMCP (ThermoMechanical Control Process) is applied are well-known as methods for producing a heavy-wall H-shaped steel having satisfactory strength, toughness and weldability.

For example, Japanese Patent Publication No. 56-35734 discloses a method for producing a gauge H steel with reinforced flanges, wherein a raw material is processed into a gauge H steel by hot rolling and then quenched to a temperature within a range of the $Ar_1$ point to the Ms point from the external surface of the flange. Subsequently, the steel is air-cooled to form a fine low-temperature-transformed microstructure.

Further, Japanese Patent Publication No. 58-10442 discloses a method for producing a high tensile strength steel with excellent workability, wherein a heated steel is rolled at a low temperature within a range of 980° C. to the $Ar_3$ point with a rolling reduction of 30% or more to cause crystallization of ferrite, and then quenched to form a dual-phase microstructure of ferrite and martensite.

When applied to production of heavy-wall H-shaped steels, the methods taught in those publications cause many problems which could be attributed to quenching performed from the external surface of the flanges after hot rolling. For example, the strength and toughness in the thickness direction of the flanges are extremely irregular, and residual stress or distortion occur frequently.

Japanese Unexamined Patent Publication No. 3-191020 discloses a method for obtaining a gauge H steel having a low yield point and high tensile strength wherein a steel is mixed with Nb and V as elements for reinforcement, and is then subjected to a coarse rolling within a recrystallization temperature range at a rolling reduction of 30% or more. A subsequent finishing rolling is performed at about 800°–850° C., which is the $Ar_3$ transformation point or higher.

This type of method utilizing Nb and comprising a rolling within a recrystallization temperature range and a rolling outside a recrystallization temperature range effectively produces gauge H steels of high strength and toughness. However, this method is inapplicable to the production of gauge H steels having a flange thickness of 40 mm or more for the same reasons discussed previously.

Furthermore, "Tetsu-to-Hagane" [Vol.77, (1991), No. 1, p.171-] discloses characteristics of "As Rolled" steels produced with the addition of V and N and having a high strength. However, satisfactory strength and toughness could not be achieved when using the rolling conditions needed for producing heavy-wall H-shaped steels, namely, a low rolling reduction and a finishing temperature of 950° C. or more.

Additionally, Japanese Unexamined Patent Publication No. 4-279248 discloses a method wherein a content of dissolved oxygen larger than usual is applied in the steelmaking step in order to generate an oxide of Ti, wherein the oxide serves as a core for crystallization of MnS, TiN and VN. In this method, Al deoxidation is not carried out, and crystallized MnS and other precipitates serve as cores for intransgranular ferrite formation to provide toughness for heavy-wall H-shaped steels.

The Publication uses a large content of dissolved oxygen while adding a Ti alloy and/or the like to the mold just before continuous casting in order to intentionally form fine Ti oxides. The Ti oxides thusly obtained serve as a core for crystallization of TiN and MnS, thereby resulting in fine ferrite which improves toughness. In addition, the steel described requires a large amount of labor in the steelmaking step and the continuous casting step since complicated processes must be performed to obtain the fine Ti oxide.

SUMMARY OF THE INVENTION

An object of the present invention is to provide a heavy-wall structural steel having excellent strength, toughness, weldability and seismic resistance, and a method for producing the same. In particular, according to the present invention, non-uniformity of strength and toughness in the thickness direction of the flanges can be greatly limited, and the heavy-wall structural steel exhibits satisfactory strength, toughness and weldability, and in addition, satisfactory seismic resistance, without having residual stress or distortion.

We have discovered that satisfactory strength and toughness can be provided for a heavy-wall structural steel even when air-cooling after hot rolling is conducted, so long as V and N are added to a steel which contains a specific content of C, Si, Mn, Cu, Ni, Cr and Mo so as to control the $Ar_3$ point to about 740°–775° C. Additionally, non-uniformity in strength and toughness, and residual stress or distortion in the thickness direction of the flanges can be minimized through a production process in which air-cooling or a gentle cooling interrupted at a high temperature after rolling is performed after rolling.

Further, a fine ferrite-pearlite microstructure can be obtained by adding V and N to the steel, crystallizing VN during the rolling process and the subsequent air-cooling process, and then, crystallizing ferrite with the cores thereof comprising the crystallized VN. A heavy-wall structural steel having excellent toughness can thusly be obtained.

Satisfactory fine microstructure cannot be obtained simply by adding V and N. A satisfactory fining effect can be obtained by hot rolling in the recrystallization temperature range for refining of austenite grain together with use of steel containing V and N. In the process, the steel is heated to about 1050°–1350° C., and then rolling on the flange region is carried out at a temperature range from about 1100° to 950° C. at a rolling reduction per pass of 5% or more and a cumulative rolling reduction of 20% or more.

Moreover, satisfactory weldability and high strength can be achieved by adjusting the chemical composition of the steel to a Ceq value within a range of about 0.36–0.42%. In addition, a fine microstructure can be provided for HAZ by adding REM, Ti and/or B. Excellent toughness can thereby be achieved.

DESCRIPTION OF THE PREFERRED EMBODIMENTS

The heavy-wall structural steel according to the present invention exhibits a tensile strength of about 490–690 MPa, a yield ratio of about 80% or less, and as an index of toughness, Charpy absorbed energy (vEo) of about 27 J or more, at the center in terms of thickness of the flange portion in each of the rolling direction (L direction), the direction perpendicular to the rolling direction (C direction), and in the plate thickness direction (Z direction). The above-specified values signify satisfactory strength, toughness, and weldability, as well as improved seismic resistance.

With a tensile strength of less than about 490 MPa, the strength of the gauge H steel is not satisfactory for use as a column member. On the other hand, a tensile strength of more than about 690 MPa deteriorates toughness and seismic resistance. Further, seismic resistance also deteriorates with a yield ratio exceeding about 80%, and brittle fracture may easily occur with a vEo of less than about 27 J.

The chemical content of the steel used in the present invention will now be described in terms of weight percentages.

C: about 0.05–0.18%.

To provide satisfactory strength, 0.05% or more of C is necessary. The upper limit is about 0.18% because the toughness and weldability of the steel deteriorate with a C content exceeding about 0.18%. A content within a range of about 0.08–0.16% is preferable.

Si: about 0.60% or less.

Si effectively improves steel strength. The content of Si is limited to about 0.60% or less because HAZ toughness will markedly deteriorate with an Si content exceeding about 0.60%. A preferable Si content is about 0.20–0.60%, since steel strength improves little when Si content is less than about 0.20%.

Mn: about 1.00–1.80%.

Mn effectively promotes steel strength. At least about 1.00% of Mn is used in the present invention to provide satisfactory strength. The upper limit of Mn is about 1.80% because the steel microstructure after rolling and air-cooling becomes a ferrite-bainite type rather than a ferrite-pearlite type when Mn content exceeds about 1.80%, thus deteriorating the toughness of the base metal. A preferable range for Mn content is about 1.20–1.70%.

Al: about 0.005–0.050%.

About 0.005% or more of Al is required for steel deoxidation. The deoxidizing effect of Al reaches a plateau at an Al content of about 0.050%, thus the upper content limit of Al is about 0.050%.

P: about 0.020% or less.

P content should be minimized because P decreases the toughness and weld-cracking resistance of the base metal and HAZ. The allowable content limit for P is about 0.020%.

S: about 0.004–0.015%.

S, like VN, has the effect of fining steel microstructure after rolling and cooling. To realize this fining effect, S content should be about 0.004% or more, though ductility in the plate-thickness direction and toughness markedly deteriorate with an S content exceeding about 0.015%. Therefore, S content should be controlled within the range of about 0.004–0.015%, and preferably within about 0.005–0.010%.

V: about 0.04–0.15%.

V is crystallized in austenite as VN during rolling and cooling, and becomes a core for ferrite transformation which results in fine crystal grains. Additionally, V has an important role in enhancing the strength of the base metal, and thus is essential for satisfactory strength and toughness in the base metal. To realize such effects, V content should be about 0.04% or more. However, when the V content exceeds about 0.15%, toughness of the base metal and weldability markedly deteriorate. Therefore, V content should be restricted to the range of about 0.04–0.15%, and preferably about 0.05–0.10%.

N: about 0.0070–0.0150%.

N enhances the strength and toughness of the base metal by bonding with V to form VN. An N content of about 0.0070% or more is necessary for this purpose. However, an N content exceeding 0.0150% markedly decreases both the toughness of the base metal and its weldability. Therefore, N content should be controlled within the range of about 0.0070–0.0150%, and preferably to about 0.0070–0.0120%.

Regarding the content ratio V/N, V and N should be contained in the invention such that V content is slightly in excess of N in stoichiometric terms. Accordingly, the weight ratio V/N should preferably be about 5 or more.

One or more elements selected from Cu, Ni, Cr, and Mo: about 0.05–0.60%, about 0.05–0.60%, about 0.05–0.50%, and about 0.02–0.20%, respectively.

Each of Cu, Ni, Cr, and Mo effectively improves hardenability, and is added in order to enhance steel strength. To realize these advantages, the contents of Cu, Ni, Cr, and Mo should be about 0.05% or more, about 0.05% or more, about 0.05% or more, and about 0.02% or more, respectively. As Cu causes deterioration of hot workability, Ni should be added together when Cu is added in a large amount. Nearly an equal amount of Ni is necessary to compensate for the deterioration of hot workability caused by the addition of Cu. However, the cost for production will be too high when Ni is contained in an amount exceeding about 0.6%, and therefore, the upper limit for the contents of Cu and Ni is about 0.60%. Meanwhile, the upper content limits of Cr and Mo are about 0.50% and 0.20%, respectively, because steel weldability and toughness will deteriorate when the contents exceed those values.

Additionally, the cooling transformation temperature, namely, the $Ar_3$ point, is lowered by the addition of Cu, Ni, Cr, and/or Mo. In the present invention, the $Ar_3$ point of the steel is controlled to about 740°–775° C. by adjusting the contents of Cu, Ni, Cr, and Mo. We discovered that controlling the $Ar_3$ point temperature to below about 775° C. optimizes the effects of VN in promoting crystallization and fine grains. However, when the $Ar_3$ point is restricted to less than about 740° C., the transformation will predominantly generate bainite instead of ferrite. For that reason, the production of fine grains will not be satisfactory, and crystallization promotion will be limited.

B: about 0.0002–0.0020%

B is crystallized as BN during the rolling process, which promotes the formation of finer ferrite grains after the rolling process. This effect can be realized with a B content of about 0.0002% or more. The upper content limit for B is about 0.0020% because toughness will deteriorate when B content exceeds about 0.0020%.

Ti and/or REM (Rare Earth Metal): about 0.005–0.015% and about 0.0010–0.0200%, respectively.

Ti and each of REMs finely disperse in the base metal as crystals of TiN and REM oxides even at a high temperature, which not only inhibits granular growth of γ grains during heating for rolling, but also promotes the formation of finer ferrite grains after the rolling process. High steel strength and toughness can thusly be secured. Ti and each of REMs also inhibit the granular growth of γ grains during heating for welding, thereby promoting a fine microstructure and HAZ toughness. Realization of these effects requires about 0.005% or more Ti and/or 0.0010% or more REM. When the steel contains about 0.015% or more of Ti and/or about 0.0200% or more of a REM, the cleanliness and toughness of the steel will deteriorate.

Adjustments of Ti content should be performed prior or during the RH degassing process if such a process is performed, or should be done during the molten steel flushing process if RH degassing process is not performed.

The Balance: The balance of the steel is Fe and incidental impurities.

Ceq: The Ceq value calculated from the following equation I should be about 0.36–0.46%.

$$Ceq=C+Si/24+Mn/6+Ni/40+Cr/5+Mo/4+V/14(\%) \quad \text{I}$$

When the Ceq value exceeds about 0.45%, weld cracking increases and HAZ toughness deteriorates. On the other hand, satisfactory strength of the base metal and that of the softened HAZ portion cannot be secured with a Ceq value of less than about 0.36%. The range of the Ceq value is, therefore, controlled to about 0.36–0.45%.

$Ar_3$ point: The $Ar_3$ point as calculated from the following equation II should be about 740°–775° C.

$$Ar_3\ point=910-273C+25Si-74Mn-56Ni-16Cr-9Mo-5Cu-1620Nb\ (^\circ C.) \quad \text{II}$$

The effects of VN crystallization enhancement and the fine-grain promotion are reduced when the $Ar_3$ point exceeds about 775° C. On the other hand, when the $Ar_3$ point is below about 740° C., the steel microstructure will predominantly consist of bainite during the cooling process after the hot rolling, thus, finer granulation by crystallization of ferrite cannot be achieved. Steel toughness will deteriorate. Accordingly, the steel composition should be adjusted so as to obtain an $Ar_3$ point between about 740°–775° C.

In the present invention, a ferrite-pearlite or ferrite-pearlite-bainite microstructure predominantly consisting of ferrite comprises the microstructure of the steel to provide adequate seismic resistance in building structures. The areal ratio of ferrite should be about 50–90%. Toughness of the base metal and seismic resistance will deteriorate with an areal ratio of less than about 50%. On the other hand, when the areal ratio exceeds about 90% it is difficult to secure a tensile strength of about 490 MPa or more. For that reason, the areal ratio of ferrite is controlled within a range of about 50–90%, more preferably about 50–80%.

Further, in the present invention, the grain size determined according to JIS G0522 should be about 5 or more. With a grain size number of less than about 5, toughness will markedly deteriorate. Therefore, the grain size has been limited to about 5 or more in terms of grain size number.

The rolling and cooling conditions in accordance with the invention will now be described.

1. Steel having the above-described composition is heated to about 1050°–1350° C.

Deformation resistance of the steel becomes high when a heating temperature of less than about 1050° C. is employed for hot rolling. As a result, the rolling force required is too high to obtain a predetermined dimensional shape. On the other hand, when the heating temperature exceeds about 1350° C., the grain size of the raw material increases, and will not be reduced even by the subsequent rolling process. For that reason, the heating temperature for rolling is controlled to about 1050°–1350° C.

2. The flange portions are rolled within a rolling temperature range of about 1100°–950° C. and at a rolling reduction per pass of about 5% or more and a cumulative rolling reduction of about 20% or more.

As previously discussed, the presence of VN alone does not produce an adequately fine grain size. The fining effect of VN must be complimented by a particular rolling technique in order to achieve a remarkably fine grain size. Specifically, the rolling technique involves heating the grown γ grains in the flange portions to about 1050°–1350° C., then rolling the steel at a rolling temperature range of about 1100°–950° C. at a rolling reduction per pass of about 5–10% and a cumulative rolling reduction of about 20% or more.

In other words, recrystallization to a fine grain size can be achieved by repeating the rolling at a rolling reduction per pass of about 5–10%, required for partial recrystallization, so that the cumulative rolling reduction becomes about 20% or more. To better promote the recrystallization to a fine grain size, the rolling reduction per pass should preferably be larger. However, deformation resistance increases and accuracy of the dimensional shape decreases when using a larger rolling reduction per pass. For that reason, a light rolling reduction per pass of about 5–10% is used in the present invention. The effect of VN on achieving a fine grain size cannot be sufficiently exhibited using a rolling temperature, a rolling reduction per pass and/or a cumulative rolling reduction outside of the above-described ranges.

3. Gentle cooling interrupted at a high temperature after rolling and/or air-cooling to room temperature are carried out after the rolling process.

By performing air-cooling to room temperature after the rolling process, distortion can be prevented while uniform and excellent strength and toughness can be achieved. Alternatively, when high strength is to be obtained using a low Ceq value, or when the flange is thick, a gentle cooling including an interruption of the cooling process at a high temperature may be carried out, in which gentle cooling at a faster rate than air-cooling is performed in the high temperature range, after which air-cooling is performed. In the gentle cooling process, the cooling rate should be about 0.2°–2.0° C./sec., and the temperature at which the gentle cooling is interrupted should be about 700°–550° C. It is difficult to secure the desired strength with a cooling rate of less than about 0.2° C./sec., while bainite microstructure will be predominant and toughness will deteriorate when the cooling rate exceeds about 2.0° C./sec. For that reason, the cooling rate during the gentle cooling process is controlled to about 0.2°–2.0° C./sec. More preferably, the cooling rate should be within a range of about 0.2°–1.5° C./sec. for good steel homogeneity in the plate-thickness direction. Additionally, the grain size will increase when the temperature at which the gentle cooling is interrupted exceeds about 700° C., while the bainite microstructure will tend to predominant and toughness will deteriorate when the temperature at which the gentle cooling is interrupted is less than about 550° C. The gentle cooling-interruption temperature is therefore controlled to about 700°–550° C.

EXAMPLES

Several steels, each having a composition, $Ar_3$ point and Ceq value as shown in Table 1, were heated to 1120°–1320° C., then rolled and cooled under the conditions shown in Table 2 to obtain heavy-walled H-shaped steels each having a flange thickness of 60–100 mm. From each gauge H steel, from a portion located at a quarter or three-quarter position in terms of the flange width and one-half of the plate thickness, specimens for the tensile test and impact test prescribed in JIS No. 4 were sampled in the rolling direction (L direction), in the direction perpendicular to rolling (C direction), and in the plate-thickness direction (Z direction). Additionally, another specimen was sampled in the L direction from 10 mm under the steel surface for mechanical testing. The results are shown in Table 2.

TABLE 1-1

Example of the Invention

| Composition | C | Si | Mn | P | S | Cu | Ni | Cr | Mo | V | Nb | Al | N | B | Ti | REM | $AR_3$ | Ceq |
|---|---|---|---|---|---|---|---|---|---|---|---|---|---|---|---|---|---|---|
| A | 0.12 | 0.35 | 1.40 | 0.011 | 0.006 | 0.36 | 0.35 | — | — | 0.062 | — | 0.025 | 0.0071 | — | — | — | 761 | 0.381 |
| B | 0.10 | 0.42 | 1.43 | 0.012 | 0.007 | 0.15 | 0.21 | 0.12 | — | 0.082 | — | 0.016 | 0.0097 | 0.0003 | — | — | 773 | 0.391 |
| C | 0.14 | 0.35 | 1.52 | 0.011 | 0.005 | 0.16 | — | — | — | 0.070 | — | 0.025 | 0.0111 | — | 0.010 | — | 767 | 0.413 |
| D | 0.16 | 0.25 | 1.31 | 0.011 | 0.010 | 0.16 | 0.29 | — | 0.08 | 0.062 | — | 0.030 | 0.0080 | — | 0.012 | — | 758 | 0.420 |
| E | 0.08 | 0.39 | 1.77 | 0.014 | 0.008 | — | — | 0.22 | — | 0.067 | — | 0.022 | 0.0069 | — | — | 0.0043 | 763 | 0.440 |
| F | 0.12 | 0.44 | 1.40 | 0.011 | 0.006 | 0.45 | 0.40 | — | — | 0.061 | — | 0.028 | 0.0130 | — | — | — | 760 | 0.386 |
| F | 0.14 | 0.38 | 1.43 | 0.015 | 0.005 | — | — | 0.24 | — | 0.101 | — | 0.034 | 0.0082 | — | — | — | 772 | 0.449 |
| H | 0.13 | 0.21 | 1.45 | 0.010 | 0.007 | 0.11 | 0.08 | — | — | 0.061 | — | 0.022 | 0.0078 | — | — | — | 767 | 0.387 |
| I | 0.16 | 0.25 | 1.35 | 0.010 | 0.005 | 0.15 | 0.31 | — | 0.15 | 0.085 | — | 0.028 | 0.0086 | — | — | — | 753 | 0.447 |
| J | 0.13 | 0.32 | 1.67 | 0.013 | 0.009 | — | 0.16 | — | — | 0.077 | — | 0.036 | 0.0108 | 0.0005 | — | 0.0052 | 750 | 0.431 |

The term "$Ar_3$" refers to the $Ar_3$ point (° C.)
The other numerical values are expressed in terms of weight percentage.

TABLE 1-2

Comparative Examples

| Composition | C | Si | Mn | P | S | Cu | Ni | Cr | Mo | V | Nb | Al | N | B | Ti | REM | $AR_3$ | Ceq |
|---|---|---|---|---|---|---|---|---|---|---|---|---|---|---|---|---|---|---|
| K | 0.19 | 0.41 | 1.59 | 0.011 | 0.005 | 0.33 | 0.31 | — | 0.08 | 0.063 | — | 0.031 | 0.0080 | — | — | — | 731 | 0.504 |
| L | 0.08 | 0.40 | 1.45 | 0.015 | 0.005 | — | — | — | — | 0.091 | — | 0.015 | 0.0170 | — | — | — | 791 | 0.345 |
| M | 0.14 | 0.38 | 1.51 | 0.010 | 0.005 | 0.25 | 0.36 | 0.22 | — | 0.055 | 0.015 | 0.025 | 0.0032 | — | — | — | 720 | 0.464 |
| N | 0.13 | 0.38 | 1.48 | 0.011 | 0.005 | 0.36 | 0.25 | — | — | — | — | 0.036 | 0.0034 | — | — | — | 757 | 0.400 |

The term "$Ar_3$" stands for $Ar_3$ (° C.)
The other numerical values are expressed in terms of weight percentage.

TABLE 2-1

Examples of the Invention
Composition A

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Ferrite Grain Size Number | Mechanical Characteristics YS (MPa) | TS (MPa) | YR (%) | νEo $E_0$ (J) |
|---|---|---|---|---|---|---|---|---|---|---|---|---|---|---|
| A-1 | 1250 | 5–8 | 42 | 80 | Air-cooling | Surface | L | F + P | 75 | 7 | 425 | 582 | 73 | 285 |
| | | | | | | ½ t | L | F + P | 77 | 6.5 | 405 | 570 | 71 | 277 |
| | | | | | | ½ t | C | | | | 416 | 568 | 73 | 153 |
| | | | | | | ½ t | Z | | | | 398 | 546 | 73 | 66 |
| A-2 | 1250 | 5–8 | 30 | 100 | Air-cooling | Surface | L | F + P | 73 | 6.5 | 388 | 562 | 69 | 226 |
| | | | | | | ½ t | L | F + P | 76 | 6 | 378 | 556 | 68 | 198 |
| | | | | | | ½ t | C | | | | 392 | 560 | 70 | 109 |

TABLE 2-1-continued

Examples of the Invention Composition A

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Ferrite Grain Size Number | Mechanical Characteristics YS (MPa) | TS (MPa) | YR (%) | νEo $E_o$ (J) |
|---|---|---|---|---|---|---|---|---|---|---|---|---|---|---|
| | | | | | | ½ t | Z | | | | 370 | 546 | 68 | 51 |
| A-3 | 1150 | 5–7 | 25 | 100 | Air-cooling | Surface | L | F + P | 76 | 7 | 385 | 550 | 70 | 252 |
| | | | | | | ½ t | L | F + P | 79 | 7 | 376 | 545 | 69 | 233 |
| | | | | | | ½ t | C | | | | 361 | 544 | 66 | 168 |
| | | | | | | ½ t | Z | | | | 359 | 550 | 65 | 82 |
| A-4 | 1150 | 5–8 | 27 | 100 | Water-Cooling during 980 to 650° C. at a Rate of 0.9° C./s | Surface | L | F + P + B | 74 | 7.5 | 454 | 598 | 76 | 178 |
| | | | | | | ½ t | L | F + P + B | 76 | 7 | 433 | 586 | 74 | 181 |
| | | | | | | ½ t | C | | | | 439 | 576 | 76 | 101 |
| | | | | | | ½ t | Z | | | | 411 | 555 | 74 | 52 |

F: Ferrite
P: Pearlite
B: bainite

TABLE 2-2

Examples of the Invention Composition B and C

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Ferrite Grain Size Number | Mechanical Characteristics YS (MPa) | TS (MPa) | YR (%) | νEo $E_o$ (J) |
|---|---|---|---|---|---|---|---|---|---|---|---|---|---|---|
| B-1 | 1200 | 5–7 | 32 | 80 | Air-cooling | Surface | L | F + P | 78 | 7 | 373 | 544 | 69 | 305 |
| | | | | | | ½ t | L | F + P | 80 | 6.5 | 359 | 531 | 68 | 268 |
| | | | | | | ½ t | C | | | | 358 | 526 | 68 | 189 |
| | | | | | | ½ t | Z | | | | 355 | 526 | 67 | 88 |
| C-1 | 1300 | 6–10 | 30 | 80 | Air-cooling | Surface | L | F + P + B | 78 | 6 | 488 | 624 | 78 | 224 |
| | | | | | | ½ t | L | F + P + B | 70 | 5.5 | 451 | 590 | 76 | 186 |
| | | | | | | ½ t | C | | | | 444 | 583 | 76 | 112 |
| | | | | | | ½ t | Z | | | | 439 | 592 | 74 | 48 |
| C-2 | 1150 | 5–7 | 25 | 100 | Water-cooling during 980 to 650° C. at a Rate of 1.3° C./s | Surface | L | F + P + B | 60 | 7.5 | 518 | 652 | 79 | 183 |
| | | | | | | ½ t | L | F + P + B | 68 | 7 | 478 | 632 | 76 | 154 |
| | | | | | | ½ t | C | | | | 473 | 635 | 74 | 128 |
| | | | | | | ½ t | Z | | | | 457 | 614 | 74 | 68 |

F: Ferrite
P: Pearlite
B: Bainite

TABLE 2-3

Examples of the Invention Composition D, E and F

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Ferrite Grain Size Number | Mechanical Characteristics YS (MPa) | TS (MPa) | YR (%) | νEo $E_o$ (J) |
|---|---|---|---|---|---|---|---|---|---|---|---|---|---|---|
| D-1 | 1250 | 6–9 | 27 | 100 | Air-cooling | Surface | L | F + P | 62 | 6 | 478 | 644 | 74 | 167 |
| | | | | | | ½ t | L | F + P | 64 | 6 | 469 | 628 | 75 | 141 |
| | | | | | | ½ t | C | | | | 450 | 632 | 71 | 93 |
| | | | | | | ½ t | Z | | | | 448 | 629 | 71 | 50 |
| E-1 | 1120 | 5–10 | 43 | 100 | Water cooling during 980 | Surface | L | F + P + B | 73 | 8 | 430 | 584 | 74 | 222 |
| | | | | | | ½ t | L | F + P + B | 81 | 7 | 392 | 546 | 72 | 193 |
| | | | | | | ½ t | C | | | | 388 | 546 | 71 | 139 |

TABLE 2-3-continued

Examples of the Invention
Composition D, E and F

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Grain Size Number | Mechanical Characteristics YS (MPa) | TS (MPa) | YR (%) | νEo $E_o$ (J) |
|---|---|---|---|---|---|---|---|---|---|---|---|---|---|---|
| | | | | | to 650° C. at a Rate of 1.8° C./s | ½ t | Z | | | | 376 | 538 | 70 | 88 |
| F-1 | 1250 | 6–9 | 25 | 60 | Air-Cooling | Surface | L | F + P | 76 | 6 | 386 | 543 | 71 | 267 |
| | | | | | | ½ t | L | F + P | 76 | 6 | 380 | 550 | 69 | 222 |
| | | | | | | ½ t | C | | | | 376 | 551 | 68 | 106 |
| | | | | | | ½ t | Z | | | | 364 | 542 | 67 | 57 |

F: Ferrite
P: Pearlite
B: Bainite

TABLE 2-4

Examples of the Invention
Composition D, E and F

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Grain Size Number | Mechanical Characteristics YS (MPa) | TS (MPa) | YR (%) | νEo $E_o$ (J) |
|---|---|---|---|---|---|---|---|---|---|---|---|---|---|---|
| G-1 | 1200 | 5–8 | 25 | 80 | Air-cooling | Surface | L | F + P | 68 | 6.5 | 399 | 572 | 70 | 232 |
| | | | | | | ½ t | L | F + P | 68 | 6.5 | 375 | 567 | 66 | 218 |
| | | | | | | ½ t | C | | | | 375 | 560 | 67 | 120 |
| | | | | | | ½ t | Z | | | | 369 | 551 | 67 | 72 |
| H-1 | 1150 | 6–8 | 28 | 100 | Air-cooling | Surface | L | F + P | 75 | 7.5 | 387 | 526 | 74 | 282 |
| | | | | | | ½ t | L | F + P | 76 | 7.5 | 369 | 530 | 70 | 246 |
| | | | | | | ½ t | C | | | | 379 | 541 | 70 | 103 |
| | | | | | | ½ t | Z | | | | 360 | 533 | 68 | 51 |
| I-1 | 1250 | 7–10 | 28 | 80 | Air-Cooling | Surface | L | F + P | 68 | 5.5 | 463 | 638 | 73 | 169 |
| | | | | | | ½ t | L | F + P | 70 | 5.5 | 444 | 615 | 72 | 160 |
| | | | | | | ½ t | C | | | | 448 | 620 | 72 | 93 |
| | | | | | | ½ t | Z | | | | 440 | 613 | 72 | 49 |

F: Ferrite
P: Pearlite
B: Bainite

TABLE 2-5

Comparative Example
Compositions K, L and M

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Grain Size Number | Mechanical Characteristics YS (MPa) | TS (MPa) | YR (%) | νEo $E_o$ (J) |
|---|---|---|---|---|---|---|---|---|---|---|---|---|---|---|
| K-1 | 1150 | 5–8 | 28 | 100 | Air-cooling | Surface | L | F + P | 61 | 7 | 417 | 595 | 70 | 52 |
| | | | | | | ½ t | L | F + P | 62 | 7 | 407 | 590 | 69 | 77 |
| | | | | | | ½ t | C | | | | 400 | 588 | 68 | 46 |
| | | | | | | ½ t | Z | | | | 407 | 593 | 69 | 17 |
| L-1 | 1320 | 7–10 | 30 | 100 | Air-cooling | Surface | L | F + P | 85 | 8 | 458 | 621 | 74 | 68 |
| | | | | | | ½ t | L | F + P | 83 | 8 | 466 | 609 | 77 | 51 |
| | | | | | | ½ t | C | | | | 453 | 599 | 76 | 34 |
| | | | | | | ½ t | Z | | | | 442 | 582 | 76 | 21 |

TABLE 2-5-continued

Comparative Example
Compositions K, L and M

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Ferrite Grain Size Number | Mechanical Characteristics YS (MPa) | TS (MPa) | YR (%) | νEo $E_0$ (J) |
|---|---|---|---|---|---|---|---|---|---|---|---|---|---|---|
| M-1 | 1200 | 6–9 | 28 | 100 | Air-Cooling | Surface | L | F + P + B | 73 | 4.5 | 420 | 568 | 74 | 29 |
| | | | | | | ½ t | L | F + P + B | 75 | 4.5 | 397 | 551 | 72 | 41 |
| | | | | | | ½ t | C | | | | 401 | 543 | 74 | 30 |
| | | | | | | ½ t | Z | | | | 382 | 529 | 72 | 13 |

F: Ferrite
P: Pearlite
B: Bainite

TABLE 2-6

Comparative Example
Compositions N, A and C

| No. | Heating Temperature (° C.) | Rolling Reduction per Pass (%) | Cumulative Rolling Reduction (%) | Flange Thickness (mm) | Conditions for cooling after Rolling | Sampling Position | Sampling Direction | Microstructure | Ferrite Areal Ratio (%) | Ferrite Grain Size Number | Mechanical Characteristics YS (MPa) | TS (MPa) | YR (%) | νEo $E_0$ (J) |
|---|---|---|---|---|---|---|---|---|---|---|---|---|---|---|
| N-1 | 1250 | 6–9 | 28 | 100 | Air-cooling | Surface | L | F + P + B | 76 | 4 | 358 | 511 | 70 | 44 |
| | | | | | | ½ t | L | F + P + B | 78 | 4 | 342 | 496 | 69 | 38 |
| | | | | | | ½ t | C | | | | 333 | 482 | 69 | 29 |
| | | | | | | ½ t | Z | | | | 340 | 491 | 69 | 11 |
| A-5 | 1150 | 5–8 | 25 | 100 | Water-cooling during 980 to 450° C. at a Rate of 1.6° C./s | Surface | L | F + P + B | 45 | 8.5 | 543 | 662 | 82 | 112 |
| | | | | | | ½ t | L | F + P + B | 61 | 7.5 | 453 | 588 | 77 | 94 |
| | | | | | | ½ t | C | | | | 446 | 576 | 77 | 74 |
| | | | | | | ½ t | Z | | | | 436 | 571 | 76 | 47 |
| C-3 | 1320 | 3–6 | 14 | 100 | Air-Cooling | Surface | L | F + P + B | 60 | 5 | 391 | 558 | 70 | 28 |
| | | | | | | ½ t | L | F + P + B | 63 | 4.5 | 378 | 540 | 70 | 41 |
| | | | | | | ½ t | C | | | | 383 | 541 | 71 | 33 |
| | | | | | | ½ t | Z | | | | 385 | 532 | 72 | 10 |

F: Ferrite
P: Pearlite
B: Bainite

As is obvious from Table 2, each of the gauge H steels A-1 to A-4, B-1, C-1, C-2, D-1, E-1, F-1, G-1, H-1 and I-1, each being in accordance with the invention, exhibits a toughness in each of the L, C, and Z directions of 48 J or more, shows little difference in strength between the surface and the central portion of the plate, and possesses a tensile strength of 520 MPa or more, and a yield ratio of 80% or less.

Meanwhile, the comparative example gauge H steels K-1, L-1, M-1 and N-1 do not possess at least one of the elements of the invention (C, V and/or N content, Ceq value, and/or $Ar_3$ point) resulting in relatively low νEo values on the whole. Further, some of these Comparative Examples exhibit a high YR value of 80% or more, while others are low in strength.

The gauge H steels A-5 and C-3 as Comparative Examples have compositions in accordance with the invention, but the rolling and cooling conditions are outside of the specific ranges of the invention. The gauge H steel A-5, which was produced with a low cooling-cessation temperature, had portions in which the ferrite areal ratios were less than 50%, showed a large strength difference between the surface and the central portion of the plate, and had a surface YR value exceeding 80%. The gauge H steel C-3 was produced using a cumulative rolling reduction less than required in the invention, which resulted in a grain size of less than 5 and unsatisfactory toughness.

Next, an oblique Y-groove weld cracking test as prescribed in JIS Z 3158 was performed to evaluate the weld cracking tendency of the steels. Using the gauge H steels A-1, D-1 and H-1 as Examples of the Invention and K-1 and M-1 as Comparative Examples, test specimens having a plate thickness of 50 mm, a length of 200 mm and a width of 150 mm were sampled from the flanges. A covered electrode for high tensile strength steels was used for the testing under the conditions of 170 amperes, 24 volts and at the rate of 150 mm/min. The preheating temperature for the welding was 50° C. Cracking was observed in Comparative Example steels K-1 and M-1, while no cracking was seen in steels A-1, D-1 and H-1.

As described above, the present invention is industrially advantageous. The invention exhibits characteristics found in no prior art heavy-wall structural steel. Specifically, the invention provides an heavy-wall structural steel having excellent toughness against impact, excellent weldability, and high strength with excellent strength uniformity in the plate-thickness direction.

Although this invention has been described with reference to specific elements and method steps, equivalent elements and method steps may be substituted, the sequence of method steps may be varied, and certain elements and method steps may be used independently of others. Further, various other elements and control steps may be included, all without departing from the spirit and scope of the invention defined in the appended claims.

What is claimed is:

1. A method for producing a heavy-wall structural steel having a flange portion with a flange thickness of about 40 mm or more, possessing excellent strength, toughness, weldability and seismic resistance, said method comprising:

heating a steel to about 1050°–1350° C., rolling said flange portion of said steel in a temperature range from about 1100°–950° C. at a rolling reduction per pass of about 5–10% and at a cumulative rolling reduction of about 20% or more, and air-cooling said steel to room temperature;

wherein said steel comprises, in terms of weight percentage, about 0.05–0.18% of C, about 1.00–1.80% of Mn, about 0.020% or less of P, about 0.04–0.15% of V, about 0.60% or less of Si, about 0.005–0.050% of Al, about 0.004–0.015% of S, about 0.0070–0.0150% of N, at least one element selected from the group consisting of about 0.05–0.60% of Cu, about 0.05–0.60% of Ni, about 0.05–0.50% of Cr and about 0.02–0.20% of Mo, and the balance Fe and incidental impurities; said steel having a Ceq value of about 0.36–0.45 wt %, Ceq being defined by the following equation I:

$$Ceq(wt\ \%)=C+Si/24+Mn/6+Ni/40+Cr/5+Mo/4+V/14 \quad \text{I,}$$

and an $Ar_3$ point of about 740°–775° C., defined by the following equation II:

$$Ar_3\ point\ (°C.)=910-273C+25Si-74Mn-56Ni-16Cr-9Mo-5Cu-1620Nb \quad \text{II; and}$$

wherein said steel has a flange portion having at a center of thickness in each of the rolling direction, the direction perpendicular to the rolling direction, and the plate thickness direction, Charpy absorbed energy value at 0° C. of about 27 J or more, a yield ratio of about 80% or less, and a tensile strength of about 490–690 MPa.

2. A method for producing a heavy-wall steel according to claim 1, wherein before said step of air cooling said steel to room temperature, said steel is cooled to about 700°–550° C. at a cooling rate of about 0.2°–2.0° C./sec.

3. The method for producing a heavy-wall steel according to claim 1, wherein said steel further comprises about 0.0002–0.0020% of B.

4. The method for producing a heavy-wall steel according to claim 2, wherein said steel further comprises about 0.0002–0.0020% of B.

5. The method for producing a heavy-wall steel according to claim 1, wherein said steel further comprises at least one element selected from the group consisting of about 0.005–0.015% of Ti and about 0.0010–0.0200% of REM.

6. The method for producing a heavy-wall steel according to claim 2, wherein said steel further comprises at least one element selected from the group consisting of about 0.005–0.015% of Ti and about 0.0010–0.0200% of REM.

7. The method for producing a heavy-wall steel according to claim 1, wherein said steel further comprises about 0.0002–0.0020% of B and at least one element selected from the group consisting of about 0.005–0.015% of Ti and about 0.0010–0.0200% of REM.

8. The method for producing a heavy-wall steel according to claim 2, wherein said steel further comprises about 0.0002–0.0020% of B and at least one element selected from the group consisting of about 0.005–0.015% of Ti and about 0.0010–0.0200% of REM.

* * * * *

UNITED STATES PATENT AND TRADEMARK OFFICE

CERTIFICATE OF CORRECTION

PATENT NO. : 5,882,447
DATED : March 16, 1999
INVENTOR(S) : Kimura et al

It is certified that error appears in the above-identified patent and that said Letters Patent is hereby corrected as shown below:

In Column 8, at Table 1-1, at the subheading "N" in example "A", please change "0.0071" to --0.0077--.

In Column 7, at Table 1-2, at the subheading "Ni", in example "N", please change "0.25" to --0.28--.

Signed and Sealed this

Thirty-first Day of August, 1999

*Attest:*

Q. TODD DICKINSON

*Attesting Officer*

*Acting Commissioner of Patents and Trademarks*